US007407150B1

(12) United States Patent
Bellantoni

(10) Patent No.: US 7,407,150 B1
(45) Date of Patent: Aug. 5, 2008

(54) SELF-STABILIZING SUSPENSION AND HOISTING SYSTEM

(76) Inventor: John F. Bellantoni, 110 N. Warbler La., Sarasota, FL (US) 34236

( * ) Notice: Subject to any disclaimer, the term of this patent is extended or adjusted under 35 U.S.C. 154(b) by 0 days.

(21) Appl. No.: 11/894,471

(22) Filed: Aug. 21, 2007

(51) Int. Cl.
*B66D 1/36* (2006.01)

(52) U.S. Cl. ..... 254/337; 254/285; 254/397

(58) Field of Classification Search ..... 254/284, 254/285, 336, 337, 394, 397
See application file for complete search history.

(56) References Cited

U.S. PATENT DOCUMENTS 3,801,070 A * 4/1974 Piasecki ..... 254/285
4,181,291 A * 1/1980 Gulliksson ..... 254/285
4,401,335 A 8/1983 Godbersen
5,074,528 A * 12/1991 Long, Jr. ..... 254/285
5,090,841 A 2/1992 Penick, Jr. et al.
5,257,891 A * 11/1993 Baumann et al. ..... 414/460
5,427,471 A 6/1995 Godbersen
5,603,420 A * 2/1997 Swanson ..... 212/274
6,640,736 B1 11/2003 McLaughlin et al.
6,926,260 B1 * 8/2005 De Groot et al. ..... 254/277
7,070,171 B2 7/2006 Mangin

* cited by examiner

*Primary Examiner*—Emmanuel M Marcelo
(74) *Attorney, Agent, or Firm*—Charles J. Prescott

(57) ABSTRACT

A load hoisting system for raising and lowering a load. A first line supports a rigid beam with unequal mechanical advantages on either side of the load. A second line supports the same rigid beam with mechanical advantages on either side of the load that are, in total, equal to those on the first line but with a ratio of mechanical advantages unequal to the ratio of mechanical advantages of the first line. One end of each line is fastened to a fixed support and the other ends of the two lines are drawn at the same rate by a power source, which system eliminates all axial rotation of the beam. The system may be applied to both ends of a long load by drawing of all lines in synchronism, advantageously being applied to lift both ends of a boat.

3 Claims, 3 Drawing Sheets

SELF-STABILIZING SUSPENSION AND HOISTING SYSTEM

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the field of lifts and more particularly to self-stabilizing hoists and suspension systems such as those for suspending and lowering and lifting watercraft into and from the water.

2. Description of Related Art

Mechanisms for lifting, lowering and suspending large loads have been in use for centuries. In particular, pulley and cable systems are especially useful because they are light, strong, adaptable to many loads and easily powered by a motor or a manually driven winch. In lifting large loads, it is often inconvenient or impossible to provide for cables or structural members that pass overhead across the load. This is particularly true of large loads, such as vessels or machinery, or in mobile applications in which it is difficult or expensive to transport a large overhead structure to a remote location.

In addition, it is desirable in most applications to lift and lower the load without allowing it to tilt, which can affect liquids in the load, and which can move the center of gravity of the load to one side or the other, rendering the system unstable.

In view of the foregoing, it is self-evident that a simple mechanism that lifts and lowers large loads without side-to-side rotation, and without the use of cables or structural members that pass over the load, has significant benefits. Several patents have attempted to address this need.

U.S. Pat. No. 7,070,171 is directed to a suspension and hoisting system including two cable circuits, each including a cable fixed at one end and attached to as lifting apparatus, such as a winch, at the other, and being reeved around deflection pulleys mounted on two parallel shafts located at either end of the load support, and with the lifting apparatus of each cable being mounted above the load support on the side of the load that is opposite its fixed end. The cable of at least one of the cable circuits is reeved successively around at least two coaxial deflection pulleys mounted on each end shaft in such a way that on at least one of the shafts at least one pulley of one cable circuit rotates in the same direction as at least one pulley of the other cable circuit under identical lifting and lowering action of the two lifting apparatus, while these two pulleys are constrained to rotate in opposite directions by any downwardly oriented force independent of the action of the lifting apparatus. Accordingly, these two pulleys are interlocked to reduce or eliminate any tendency of the load support to incline under the effect of this downward force.

This '171 patent suffers from reliance on friction between cable and pulley to prevent the downward force from lowering one end of the load. In many applications, maintaining a friction-free contact between pulley and cable is difficult because of the presence water, grease, and dirt on the cables. Moreover, the two cable circuits are of unequal length, which results in unequal elongation under temperature variations, which will tend to make one or the other cable prone to slipping.

U.S. Pat. No. 5,427,471 is directed to a boat lift, including a vertical main post mounted on dock with the lower end mounted in the water but spaced above the floor of the water. A frame includes an outer guidepost having a base mounted on the water floor with an upper end above the water level; the frame connected by a single member to the main post. A platform unit for supporting a small boat is slidably connected at both ends to the main post and the guide post, and a cable and winch unit is interconnected among the foregoing elements for effecting a level lifting and lowering of the platform unit into and out of the water. This patent requires one end of the cable to be secured at the bottom of the main post, at which point it is continually immersed in the water. This requires frequent replacement of the cable, or the use of a non-corrosive cable material, which adds considerably to the cost of installation and maintenance.

U.S. Pat. No. 6,640,736 is directed to a synchronously driven, multiple cable boat lift used in combination with proximal and distal support structures located on respective sides of a boat to selectively lift and lower the boat out of and into a body of water. The boatlift includes a motor mountable on the proximal support structure and being selectively driven in opposing first and second directions. A boat accommodating platform is located between the proximal and distal supporting structures. A plurality of lift cables operably interconnect the motor and the platform for synchronously raising and lowering the platform. This patent does not provide a mechanism to prevent the boat from rotating as it is raised or lowered, and is limited to small craft because of the configuration of the lifting beams.

U.S. Pat. No. 5,090,841 is directed to a boat lift in which a hydraulic pump and cylinder with a piston are mounted on a manual boat lift such that the piston rod carries a pulley which engages the lifting cable so that, when the piston moves in the cylinder, the boat will move up or down. This patent provides a motion stabilized against rotation for one side of the boat. It does not provide for stabilization against accidental roll of the boat. Further, it requires that part of the cable be immersed in the water while the boat is in the lifted position, which has the same disadvantages as U.S. Pat. No. 5,427,471. Moreover the invention calls for a piston and cylinder in addition to lines and pulleys.

U.S. Pat. No. 4,401,335 is directed to a boat hoist including a lift suspension system which results in even application of forces to points on the movable platform remote from the point of attachment of the lifting device, thus eliminating twisting of the loaded platform. This patent achieves equal loading of lift points by means of a cable arrangement similar to that of U.S. Pat. No. 5,427,471, which requires that one end of each of two cables be fixed below the surface of the water.

It is seen that all the above load lifting patents provide raising and lowering of a large load without cables or structural members passing over the load, but either allow destabilizing rotation of the load, or have one or more substantive disadvantages such as requiring mechanisms substantially more complex than a pulley and cable system, or restricting the location and type of pulleys and cable fastenings, or depending upon frictional resistance to rotation of the load.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a hoist and load suspension system for raising or lowering a rigid beam that supports a large load including: a first line supporting the rigid beam, with unequal first mechanical advantage and second mechanical advantage on either side of the load; a second line supporting the same rigid beam under the load, with a third mechanical advantage and a fourth mechanical advantage on either side of the load that are, in total, equal to the total mechanical advantage of first and second mechanical advantage, but have a different ratio of mechanical advantages; a fixed support on one side of the load, to which one end of each line is fastened; and a power source on the side of the load opposite the fixed support, to which the other ends of the two lines are attached and drawn at the same rate.

The rigid beam and load are raised or lowered by the power source without lines or beams passing over the load and without destabilizing rotation about a horizontal axis perpendicular to the rigid beam.

By employing a second pulley system, similar to that above, located at the other end of a longer load, and powered by the same source as the first pulley system, the load may be lifted at both ends without rotation about any horizontal axis, and without any lines or structures passing over the load The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference of the drawings and by study of the following descriptions.

Exemplary embodiments are illustrated in reference figures of the drawings. It is intended that the embodiments and figures disclosed herein are to be considered to illustrative rather than limiting.

DETAILED DESCRIPTION OF THE INVENTION

Figure 1:
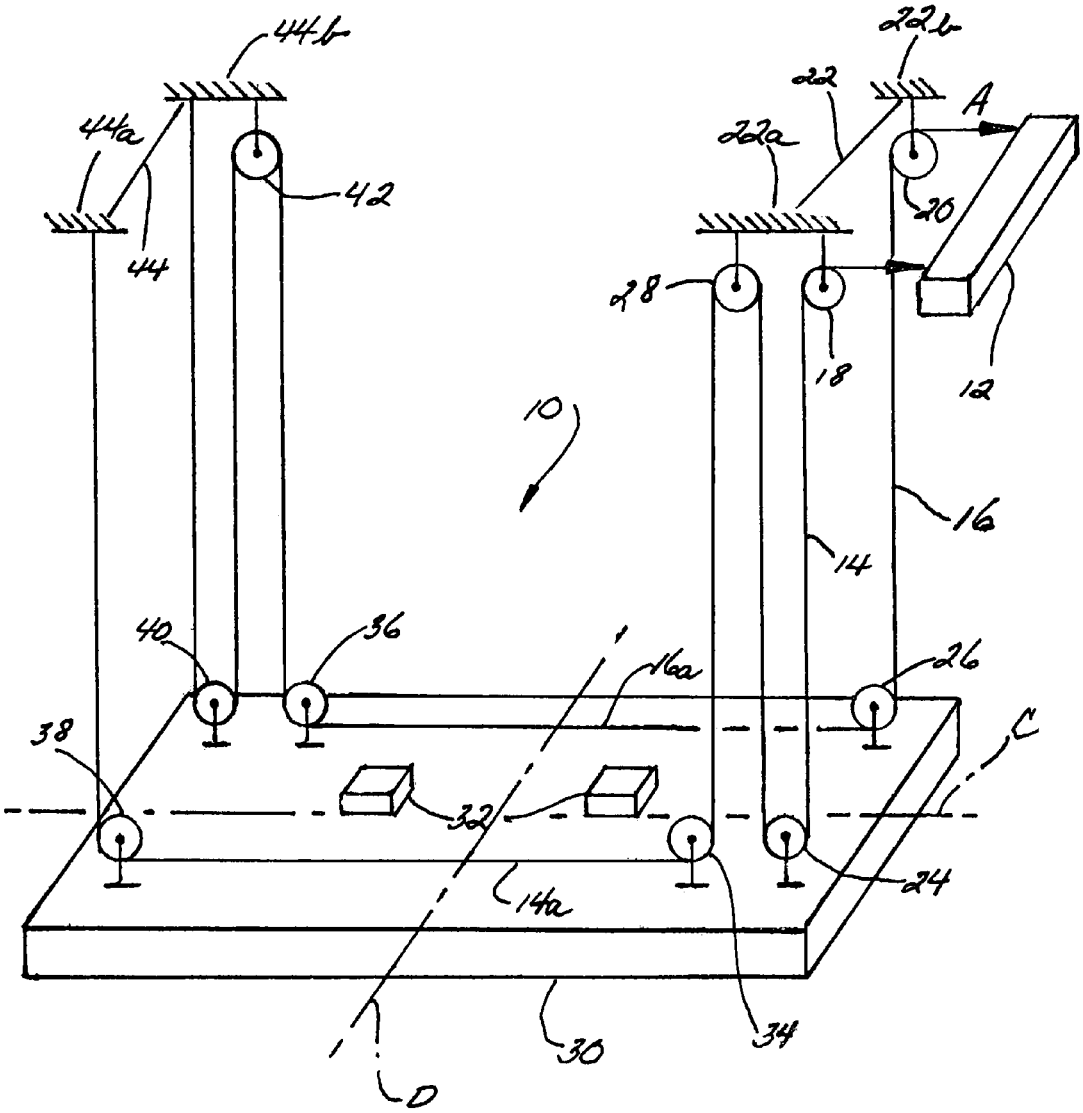
FIG. 1 illustrates one embodiment of a hoisting and suspension system of the present invention.

FIG. 1 illustrates a hoist and suspension or pulley system 10 constructed in accordance with the teachings of the present invention. The pulley system 10 is a typical embodiment of this invention, but it is one of many possible pulley systems that may be constructed as an embodiment of this invention. The system comprises the following elements shown in FIG. 1.

(1) two rigid supports 22 and 44 on either side of the load;

(2) a rigid beam 30 supporting a load (not shown for clarity) by means of blocks 32 or an equivalent structure fixed to the rigid beam 30;

(3) two non-extensible lines 14 and 16;

(4) ten pulleys, five on each of the lines of (3);

(5) a power source 12 which may be a motor, winch or other device, to which one end of each line of (3) is attached and which draws both lines simultaneously at the same rate.

These elements (1) through (5) are interconnected and operate as described in the following paragraphs:

The three pulleys on each line are attached to the rigid beam 30 supporting the load and two pulleys on each line are attached to the two fixed supports 22*a*/22*b* and 44*a*/44*b* on either side of the load, under which each line passes at 14*a* and 16*a*. One end of each line is attached to one of the fixed supports 44*a* and 44*b* while the other end of each line is drawn in the direction of arrow A by the motor, windlass or other power source 12 attached to the other fixed support 22 which cables 14 and 16, when drawn at the same rate, will lift the load without allowing it to rotate about a horizontal axis D perpendicular to the rigid beam 30.

FIG. 1 illustrates that the first line 14, which is connected to the power source 12 passes over a pulley 18 which is rigidly connected to the first fixed support at 22*a*. The first line 14 passes under pulley 24 which is connected to the rigid beam 30, and over pulley 28 which is connected to the first fixed support 22 at 22*a*. The first line 14 also passes under pulley 34 which is connected to the rigid beam 30, then across the rigid beam 30, under the load, and under pulley 38 which is connected to the rigid beam 30. The first line 14 is fixed at an end to the second fixed support 44 at 44*a*.

FIG. 1 also illustrates that the second line 16 is connected to the power source 12, and passes over a pulley 20 which is rigidly connected to the first fixed support 22 at 22*b*. The second line 16 also passes under the pulley 26 which is connected to the rigid beam 30 and along the rigid beam alongside of pulley 24, then along the rigid beam 30 and under the pulley 36 which is connected to the rigid beam 30. This second line 16 also passes over the pulley 42 which is connected to the second fixed support 44 at 44*b* and under the pulley 40 which is connected to the rigid beam 30. The second line 16 is fixed at an end to the second fixed support 44 at 44*b*. The load is carried by the rigid beam 30, and is elevated by support blocks 32 or equivalent structure above the surface of the rigid beam 30 for clearance of the lines 14 and 16. A first axis D is in the longitudinal direction and perpendicular to the rigid beam 30. A second axis C perpendicular to the first axis and in the longitudinal direction of the rigid beam 30.

Figure 2:
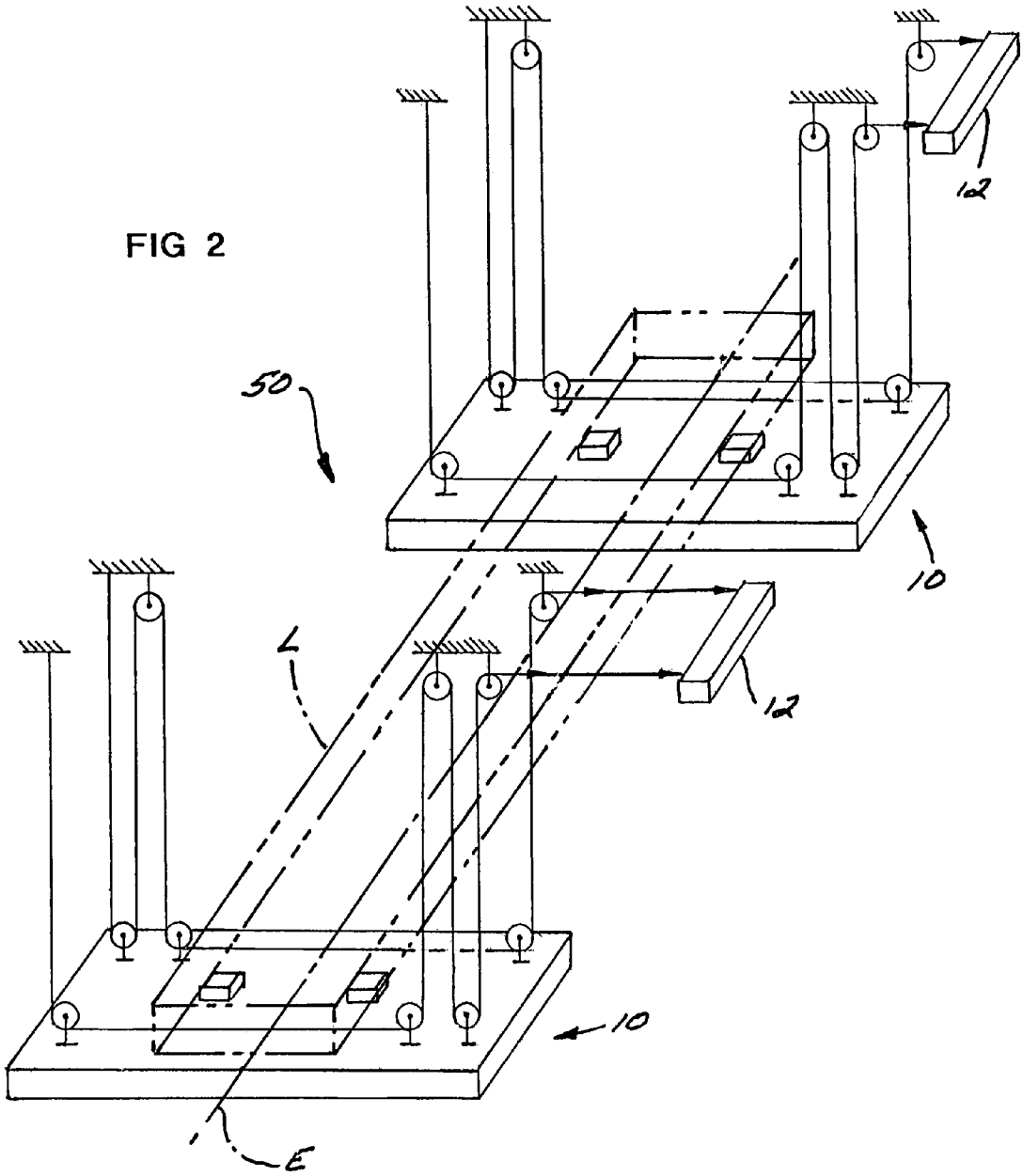
FIG. 2 illustrates another embodiment utilizing a multiple of FIG. 1 for longer and heavier loads.

FIG. 2 illustrates a double hoist system 50 formed of a substantially identical pair of hoist systems 10 shown in FIG. 1 each including first and second lines 14/16 and positioned apart at either end of the load L.

Thus, the pair of lines (the first line 14 and the second line 16) at each end of the load L, each pair 14, 16 arranged as shown in FIG. 2 and drawn at the same rate by two power sources 12, or by a single power source that draws the two lines 14 and the two lines 16 all at the same rate, will lift the load L without significant rotation about either the first or longitudinal axis E along the length of the load or about any axis which is the horizontal and perpendicular to the first axis C.

Analysis of the Invention

Referring now to the hoist system 10 of FIG. 1, the load is lifted substantially without rotation about the first axis D because of the different distribution of the number of vertical line segments, and therefore of the mechanical advantage of the two lines 14 and 16 on either side of the load as follows:

The first line 14 has length L1

$$L1=Ha\cdot n_a+Hb\cdot n_b+K$$

and the second line 16 has the length L2

$$L2=Ha\cdot m_a+Hb\cdot m_b+K$$

where Ha and Hb are the heights of the vertical line segments on the left and right sides of the load. Ha is the distance between the pulleys 38, 40 and 36 mounted on the rigid beam 30 at the left side of the load, and the fixed support 44. Hb is the distance between the pulleys 24, 26, and 34 mounted at the top surface of the rigid beam 30 on the right side of the load and the rigid support 22. Here, $n_a$ and $n_b$ are the number of vertical line segments of the first line 14 on the left and right side of the load, $m_a$ and $m_b$ are the number of vertical line segments of the second line 16 on the left and right side of the load which are equated to mechanical advantage. K is a constant representing the remainder of each line.

Small changes ΔHa and ΔHb in the heights Ha and Hb produce changes ΔL1 and ΔL2 in the line lengths:

$$\Delta L1=\Delta Ha\cdot n_a+\Delta Hb\cdot n_b$$

$$\Delta L2=\Delta Ha\cdot m_a+\Delta Hb\cdot m_b.$$

If the lines are secured to a stationary power source their lengths L1 and L2 are unchanged, giving ΔL1=ΔL2=0, or $$0=\Delta Ha\cdot n_a+\Delta Hb\cdot n_b$$

$$0=\Delta Ha\cdot m_a+\Delta Hb\cdot m_b.$$

This set of simultaneous equations has the solution ΔHa=ΔHb=0 if the matrix of coefficients $$|n_a n_b|$$

$$|m_a m_b|$$

have a non zero determinant Δ, i.e, if $$\Delta=n_a\cdot m_b-n_b\cdot m_a\#0. \qquad \text{(Condition 1)}$$

The above equation represents a constraint on $n_a$, $n_b$, $m_a$, $m_b$ and provides a sufficient condition to make the load stable against rotation about the first axis D. Analysis shows that the greater the value of Δ the greater the stability of the system against rotation about the first axis. Further, in order for the first and second lines 14, 16 to move at the same rate, the total mechanical advantage of the first line is taken to be equal to the total mechanical advantage of the second line:

$$n_a+n_b=m_a+m_b \qquad \text{(Condition 2)}$$

Conditions 1 and 2 are satisfied if, and only if, the total mechanical advantage of one line equals the total mechanical advantage of the other line, and if the ratio of the mechanical advantages of one line is unequal to the ratio of the mechanical advantages of the other line.

Configurations of the Invention at One End of a Load

The Conditions 1 and 2 constitute the essential conditions to provide both stability of the system 10 against rotational forces and simultaneous drawing of both lines by the same power source at one end of a load. These conditions apply to the number of vertical segments on each side of the load, which is the same as the number of pulleys on each side of the load, and which is also equal to the mechanical advantage on each side of the load. The conditions do not restrict the height of the fixed supports, the location of the fixed ends on the first fixed support, or the location of the power source on the second fixed support.

Therefore, in addition to the configuration shown in FIG. 1, in which the power source 12 is secured at the top of the fixed support 22 on one side and the ends of the two lines are secured at the top of the support 44 on the other side, the Conditions 1 and 2 may be satisfied when either the power source 12 or the fixed ends at 44*a* and 44*b*, or both, are at the base of their fixed supports, dependent on whether $n_a$, $n_b$, $m_a$, $m_b$ are even or odd. The conditions on the mechanical advantages and locations of the fixed end and power source which satisfy Condition 1 and Condition 2 are shown in the following table:

TABLE 1

Conditions on $n_a$, $n_b$, $m_a$, $m_b$, and the location of the Fixed Ends and Power Source allowing satisfaction of Conditions 1 and 2

| $n_a$ | $m_a$ | $n_b$ | $m_b$ | Fixed Ends | Power Source |
|---|---|---|---|---|---|
| ODD | ODD | ODD | ODD | TOP OF SUPPORT | TOP OF SUPPORT |
| ODD | ODD | EVEN | EVEN | TOP OF SUPPORT | BOTTOM OF SUPPORT |
| EVEN | EVEN | ODD | ODD | BOTTOM OF SUPPORT | TOP OF SUPPORT |
| EVEN | EVEN | EVEN | EVEN | BOTTOM OF SUPPORT | BOTTOM OF SUPPORT |

Configuration of the Invention at Both Ends of a Load

The various configurations of the invention at one end of a load may also be employed at the other end of the load, as shown in FIG. 2. In such application, a rigid beam would pass under the load at each end and a configuration of lines and pulleys at each end of the load, as described above in FIG. 1, would raise and lower each end of the load. Two configurations are possible:

(1) each end would be raised or lowered, as described above, and shown in FIG. 2, by its own power source, or (2) both ends would be raised or lowered in a coordinated manner by a single power source. In this case all four lines (two at each end of the load) would be drawn at the same rate by the same power source. Use of a single power source insures that both ends are raised at the same rate, thus avoiding rotation of the load about a horizontal axis perpendicular to the length of the load.

In the double ended configuration with a single power source, it is necessary that a third condition be satisfied:

$$n_{a1}+n_{b1}=m_{a1}+m_{b1}=n_{a2}+n_{b2}=m_{a2}+m_{b2} \qquad \text{(Condition 3)}$$

where $n_{a1}$, $n_{b1}$, $m_{a1}$, $m_{b1}$ are the mechanical advantages for the first end of the load and $n_{a2}$, $n_{b2}$, $m_{a2}$, $m_{b2}$ are the mechanical advantages for the second end of the load. In other words, this condition is that the total mechanical advantage be the same in all lines.

PREFERRED EMBODIMENT OF THE INVENTION FOR BOAT LIFTS

Those configurations in Table 1 in which the Power Source is at the bottom of the support are useful for lifting loads from the ground to a higher level off the ground, such as in building and industrial applications. Conditions in Table 1 in which the Power Source is at the top of the support are useful in lifting objects from below up to ground level or up to a secure higher level. Boat lifts, one of the primary applications of this invention, fall primarily into the latter category. The configuration shown in FIG. 1 is employed at both ends of the boat. The configurations are identical at both ends.

The configuration shown in FIG. 1 requires that $n_a$, $n_b$, $m_a$, $m_b$ be odd. For simplicity in construction, the two pulley configurations in FIG. 1 are taken to be mirror images, i.e., $$n_a=m_b$$

and $$n_b=m_a.$$

This automatically satisfies the requirement for equal mechanical advantage and gives a value for Δ:

$$\Delta=n_a \cdot n_a-n_b \cdot n_b$$

Table II (below) shows the value of D for some odd choices of $n_a$ and $n_b$, selected to make Δ>0 and as large as practical:

TABLE II

| $n_a$ | $n_b$ | D |
|---|---|---|
| 3 | 1 | 8 |
| 5 | 1 | 24 |
| 5 | 3 | 16 |

These values form the preferred embodiments of the invention for application to boat lifts.

Application to Top Rail Boat Lift

The invention may be employed advantageously in a top rail boat lift. A conventional top rail boat lift consists of two top rails, one on each side of the boat, supported parallel to the keel. Each rail supports a cylindrical bar or pipe, along the length of the rail, powered by an electric motor, with cables wound around each end of the pipe. These cables each extend down to and are fastened to the end of a rigid beam, one at each end of the pipe. These beams pass under the boat perpendicular to the keel. The other end of each rigid beam is supported by a cable wound around one end of a pipe on the top rail on the other side of the boat. That pipe is also powered by a motor.

The invention may be embodied in a top rail boat lift as follows: the first and the second lines 14 and 16, as shown in FIG. 1, are employed at the bow and two at the stern. At the bow, both lines are wound on a pipe of suitable diameter supported along the top rail that is on the dockside of the vessel. The other end of the pipe serves to wind the first and second lines 14 and 16 supporting the stern. A motor rotates this single pipe and winds both the bow and stern lines simultaneously. The four lines (two at the bow and two at the stern, a pair of first lines 14 and a pair of second lines 16) pass under the boat along or through rigid beams 30 at each end, and are secured at the top rail on the other side of the boat. That top rail has no winding pipe or motor.

A boat lift configured as described with this invention has several advantages over the conventional top rail boat lift:

(1) The boat lift is powered by one motor and one winding bar.

(2) The motor is on the dock side of the lift, facilitating installation and maintenance. This is not possible in a conventional top rail lift, since both rails are powered and one rail can be on the dock side.

(3) The boat is automatically stabilized against roll while being lifted, while a conventional top rail lift is stabilized against roll by manual control of the motor.

Whereas existing mechanisms to raise and lower large loads either require beams or lines to pass overhead of the load, or require mechanisms substantially more complex than a pulley and cable system, or restrict the location and type of pulleys and cable fastenings, or provide frictional resistance to rotation of the load, the present invention claims to provide a simple line and pulley system that has none of those disadvantages.

Figure 3:
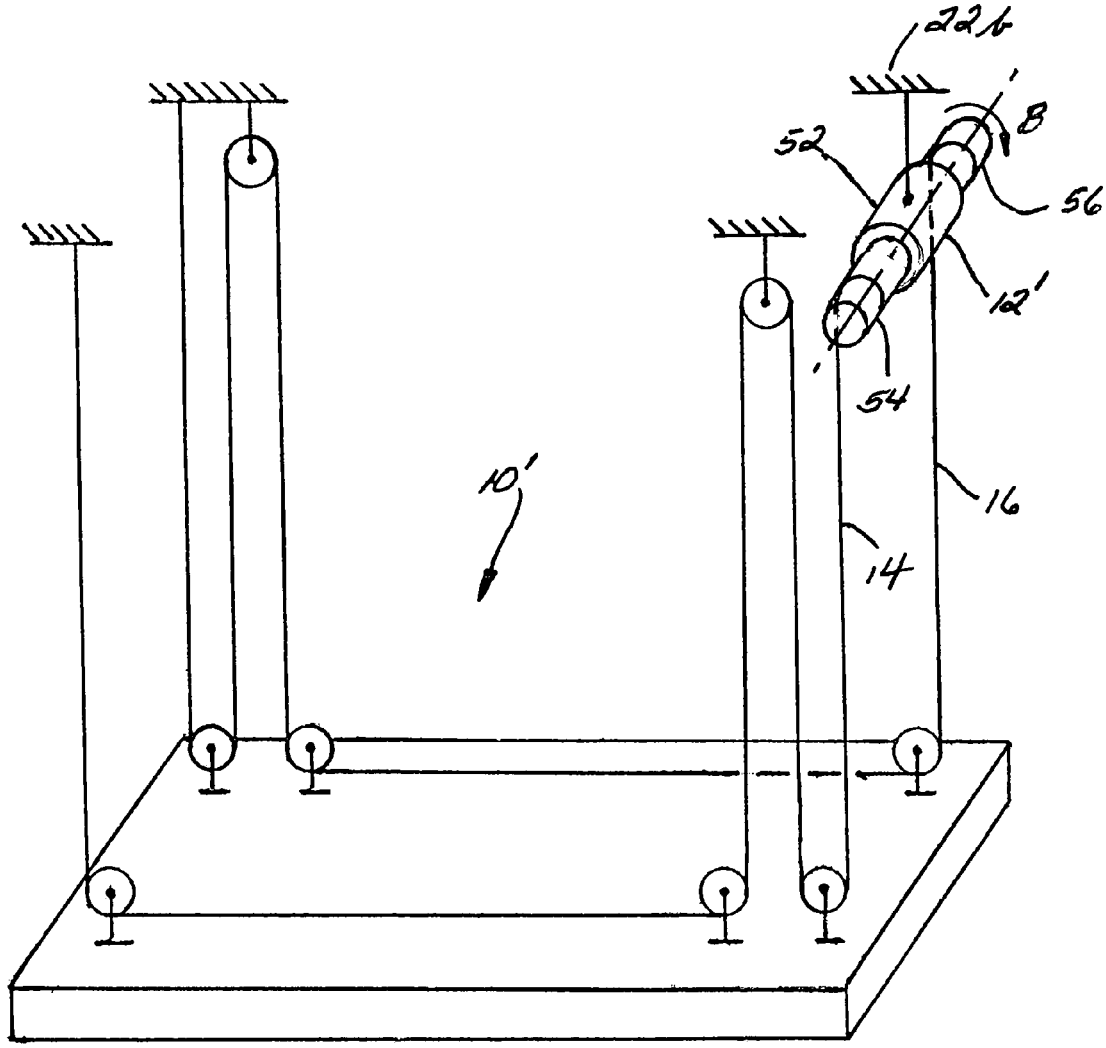
FIG. 3 illustrates an alternate power source for FIG. 1.

Referring now to FIG. 3, an alternate embodiment of FIG. 1 is there shown generally at numeral 10' having all of the attributes and features of the embodiment 10 previously described in FIG. 1 except that this embodiment 10' includes a motor 12' which is fixedly supported to fixed support 22*b*. At either end of the motor 12' are pulleys 54 and 56 which correspond to and function in a fashion similar to pulleys 18 and 20 shown in FIG. 1. Because each of the pulleys 54 and 56 are driven by the same power source 12', equal movement of both of the cables 14 and 16 is effected in the identical fashion shown in FIG. 1.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A hoist and suspension system for raising and lowering a load comprising:

first and second rigid supports, one on each side of the load;

a first inextensible line fastened to said first rigid support and passing over and under a plurality $n_a$ of pulleys including a pulley connected at a first end of a rigid beam which supports the load, said first line extending along said beam beneath the load, said first line passing to another plurality $n_b$ of pulleys including a pulley at said second end of said rigid beam and thence to a power source fixed to said second rigid support to which said first line is connected;

a second inextensible line spaced adjacent said first line and fastened to said first rigid support and passing over and under the plurality $m_a$ of pulleys including a pulley connected at the first end of said beam, said second line extending along said beam and beneath the load, said second line passing to the plurality $m_b$ of pulleys including a pulley at a second end of said beam and thence to said power source fixed on said second rigid support to which said second line is connected;

said first and second lines and corresponding pulleys producing mechanical advantages $n_a$ and $m_a$ on the first side of the load and mechanical advantages $n_b$ and $m_b$ on the other side of the load, respectively;

said total mechanical advantage $n_a$ and $n_b$ of said first line being equal to said total mechanical advantage of $m_a$ and $m_b$ said second line expressed as:

$$m_a+m_b=n_a+n_b$$

said ratio of said mechanical advantages of one line being unequal to said ratio of said mechanical advantages of said other line expressed as:

$$m_a/m_b \neq n_a/n_b$$

whereby said load is raised and lowered by said power source without said lines or said beam passing over the load, and without rotation of the load about a horizontal axis perpendicular to said rigid beam, with a positive resistance to rotation that increases expressed as:

$$|n_a m_b - n_b m_a|.$$

2. A hoist and suspension system for raising and lowering an elongated load comprising:

first and second rigid support one on each side of the load;

two spaced apart rigid beams each supporting one end of the load;

a first inextensible line fastened to said first rigid support and passing over and under a plurality $n_a$ of pulleys including a pulley connected at a first end of each of said beams, each said first line extending along said beam and passing to another plurality $n_b$ of pulleys including a pulley at said second end of said rigid beam and thence to a power source fixed to said second rigid support to which said first line is connected;

a second inextensible line spaced adjacent said first line and fastened to said first rigid support and passing over and under the plurality $m_a$ of pulleys including a pulley connected at the first end of each of said beams, each said second line extending along said beam, said second line passing to the plurality $n_b$ of pulleys including a pulley at a second end of said beam and thence to said power source fixed on said second rigid support to which said second line is connected;

said first and second lines and corresponding pulleys producing mechanical advantages $n_a$ and $m_a$ on the first side of the load and mechanical advantages $n_b$ and $m_b$ on the other side of the load, respectively;

said total mechanical advantage $n_a$ and $n_b$ of each of said first lines being equal to said total mechanical advantage $m_a$ and $m_b$ of each of said second lines expressed as:

$$m_a+m_b=n_a+n_b$$

said ratio of said mechanical advantages of one line being unequal to said ratio of said mechanical advantages of said other line expressed as:

$$m_a/m_b \neq n_a/n_b$$

whereby said load is raised and lowered by said power source without said lines or said beam passing over the load, and without rotation of the load about a horizontal axis perpendicular to said rigid beam, with a positive resistance to rotation that increases expressed as:

$$|n_a m_b - n_b m_a|.$$

3. A hoist and suspension system for raising and lowering a load comprising:

first and second rigid supports, one on each side of the load;

a first inextensible line fastened to said first rigid support and passing under a pulley connected at a first end of a rigid beam which supports the load, said first line then extending along said beam beneath the load and passing under another pulley connected at said second end of said rigid beam, over another pulley fastened to said second rigid support, under another pulley connected at said second end of said rigid beam, over another pulley fastened to said second rigid support, and thence to a power source fixed to said second rigid support to which said first line is connected;

a second inextensible line spaced adjacent to said first line and fastened to said first rigid support and passing under a pulley connected at the first end of said beam, over another pulley fastened to said first rigid support, under another pulley connected at said first end of said rigid beam, said second line then extending along said beam and passing under another pulley connected at said second end of said rigid beam, over another pulley fastened to said second rigid support and thence to said power source fixed on said second rigid support to which said second line is connected;

said first and second lines and corresponding pulleys producing total mechanical advantages which are equal one to another;

said load is raised and lowered by said power source without said lines or said beam passing over the load, and without rotation of the load about a horizontal axis perpendicular to said rigid beam.

* * * * *